US009797034B2

(12) United States Patent
Gotoh et al.

(10) Patent No.: US 9,797,034 B2
(45) Date of Patent: Oct. 24, 2017

(54) HIGH STRENGTH AND HIGH TOUGHNESS CAST STEEL MATERIAL AND METHOD FOR PRODUCING THE SAME

(75) Inventors: Yoshihiro Gotoh, Hokkaido (JP); Shinji Tanaka, Hokkaido (JP); Tsukasa Azuma, Hokkaido (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 54 days.

(21) Appl. No.: 13/498,057

(22) PCT Filed: Sep. 24, 2010

(86) PCT No.: PCT/JP2010/066602
§ 371 (c)(1),
(2), (4) Date: Mar. 23, 2012

(87) PCT Pub. No.: WO2011/037210
PCT Pub. Date: Mar. 31, 2011

(65) Prior Publication Data

US 2012/0180912 A1 Jul. 19, 2012

(30) Foreign Application Priority Data

Sep. 25, 2009 (JP) ..... 2009-220750

(51) Int. Cl.
*C22C 38/02* (2006.01)
*C22C 38/04* (2006.01)
(Continued)

(52) U.S. Cl.
CPC ..... *C22C 38/44* (2013.01); *C21D 6/00* (2013.01); *C21D 6/001* (2013.01); *C22C 38/001* (2013.01);
(Continued)

(58) Field of Classification Search
CPC ..... C21D 6/00; C21D 6/001; C22C 38/02; C22C 38/04; C22C 38/44; C22C 38/46
(Continued)

(56) References Cited

U.S. PATENT DOCUMENTS 4,474,627 A * 10/1984 Maitrepierre et al. ..... 148/540
5,900,075 A * 5/1999 Koo et al. ..... 148/328
(Continued)

FOREIGN PATENT DOCUMENTS

CN 1891843 A 1/2007
JP 51-145419 A 12/1976
(Continued)

OTHER PUBLICATIONS

Totten et al. Handbook of Quenchants and Quenching Technology, ASM International, 1993, Materials Park, OH.*
(Continued)

*Primary Examiner* — Xiaowei Su
(74) *Attorney, Agent, or Firm* — Sughrue Mion, PLLC

(57) ABSTRACT

A high strength and high toughness cast steel material of the invention has a composition comprising 0.10 to 0.20% by mass of C, 0.10 to 0.50% by mass of Si, 0.40 to 1.20% by mass of Mn, 2.00 to 3.00% by mass of Ni, 0.20 to 0.70% by mass of Cr, and 0.10 to 0.50% by mass of Mo, and further comprising Fe and unavoidable impurities. The high strength and high toughness cast steel material of the invention is produced by subjecting an ingot having the above composition to annealing at 1,000 to 1,100° C., quenching at 850 to 950° C., tempering at 610 to 670° C., and then, if desired, stress-relief annealing at less than 610° C.

13 Claims, 3 Drawing Sheets

(51) Int. Cl.

| | |
|---|---|
| ***C22C 38/44*** | (2006.01) |
| ***C22C 38/08*** | (2006.01) |
| ***C21D 6/00*** | (2006.01) |
| ***C22C 38/46*** | (2006.01) |
| ***C22C 38/00*** | (2006.01) |

(52) U.S. Cl.
CPC ..... *C22C 38/008* (2013.01); *C22C 38/02* (2013.01); *C22C 38/04* (2013.01); *C22C 38/46* (2013.01)

(58) Field of Classification Search
USPC ..... 148/663, 335
See application file for complete search history.

(56) References Cited

U.S. PATENT DOCUMENTS

| | | | | |
|---|---|---|---|---|
| 6,159,312 | A * | 12/2000 | Koo et al. | 148/336 |
| 6,245,290 | B1 * | 6/2001 | Koo et al. | 420/119 |
| 2008/0156403 | A1 * | 7/2008 | Masuda | C21D 8/065 148/653 |
| 2008/0283158 | A1 * | 11/2008 | Nagao et al. | 148/547 |

FOREIGN PATENT DOCUMENTS

| | | | | |
|---|---|---|---|---|
| JP | 55158216 | A | * | 12/1980 |
| JP | 57070266 | A | * | 4/1982 |
| JP | 5792162 | A | | 6/1982 |
| JP | 59-43853 | A | | 3/1984 |
| JP | 62-214160 | A | | 9/1987 |
| JP | 586438 | A | | 4/1993 |
| JP | 8176728 | A | | 7/1996 |
| JP | 200026934 | A | | 1/2000 |
| JP | 2000345285 | A | * | 12/2000 |
| JP | 2001181783 | A | | 7/2001 |
| JP | 2001-329332 | A | | 11/2001 |
| JP | 2002105584 | A | | 4/2002 |
| JP | 200418944 | A | | 1/2004 |
| JP | 2004514060 | A | | 5/2004 |
| JP | 200582814 | A | | 3/2005 |
| JP | 2006-274285 | A | | 10/2006 |
| JP | 2008-7820 | A | | 1/2008 |

OTHER PUBLICATIONS

Shanmugam et al. Materials Science and Engineering, 2007, vol. 460-461, p. 335-343.*
Machine translation of JP2000345285A, Dec. 2000.*
Machine translation of JP2000-345285 A, Dec. 2000.*
English Abstract of JP 55158216A, Dec. 1980.*
Machine translation of JP8176728A, Jul. 1996.*
Machine translation of JP2001181783A, Jul. 2001.*
Machine translation of JP2004-018944. Jan. 2004.*
Machine translation of JP57-070266A. Apr. 1982.*
Machine translation of JP2008-007820A, Jan. 2008.*
Japanese Industrial Standard, Test pieces for Impact Test for Metallic Materials, JIS Z 2202, Sep. 2002.*
Human translation of JP57-070266A, Apr. 1982.*
Human translation of JP55-158216A, Dec. 1980.*
International Search Report (PCT/ISA/210) dated Nov. 22, 2010 in the International Patent Application No. PCT/JP2010/066602.
Written Opinion (PCT/ISA/237) dated Nov. 22, 2010 in the International Patent Application No. PCT/JP2010/066602.
Office Action dated Mar. 14, 2013 issued by the State Intellectual Property Office of the People's Republic of China in counterpart Chinese Application No. 201080042542.5.
Communication dated Oct. 20, 2016 issued by the European Patent Office in counterpart European Patent Application No. 10818882.2.

* cited by examiner

HIGH STRENGTH AND HIGH TOUGHNESS CAST STEEL MATERIAL AND METHOD FOR PRODUCING THE SAME

TECHNICAL FIELD

The present invention relates to a high strength and high toughness cast steel material suitable for large-sized cast steel products having a large wall thickness and a complex shape and a weight exceeding 1 metric ton and also capable of being welded, and a method for producing the same.

BACKGROUND ART

As cast steel materials capable of being welded and having high toughness and high strength, SCW480, SCW550, and the like which are described in Japanese Industrial Standards have been well known. Also, in the past, steel materials shown in Patent Literatures 1 to 4 have been invented.

The steel shown in Patent Literature 1 is a pre-hardened steel for molds for plastic and has been subjected to an aging hardening heat treatment after hot working of a steel containing prescribed ingredients. In the steel shown in Patent Literature 2, high strength and high toughness are achieved by applying plastic working such as forging or rolling or high strength and high toughness are realized by cooling using a method exhibiting a high cooling effect, such as water cooling or oil cooling, in a heat treatment such as quenching, normalizing, or the like. In the steel shown in Patent Literature 3, in order to secure mechanical properties, an average cooling rate at the time of an austenitizing treatment is controlled to about 250° C./min, which is a cooling rate comparable to water cooling with regard to large-sized cast steel products having a plate thickness of about 300 mm. Moreover, in Patent Literature 4, there is disclosed a production method where a slab containing prescribed ingredients is cooled at a cooling rate of 0.5° C./second or more between solidification temperature of the slab and 1,000° C.

CITATION LIST

Patent Literature

Patent Literature 1: JP-A-2005-82814
Patent Literature 2: JP-T-2004-514060
Patent Literature 3: JP-A-2001-181783
Patent Literature 4: JP-A-2000-26934

SUMMARY OF THE INVENTION

Problems to be Solved by the Invention

However, in a cast steel material, it is difficult to apply water cooling or oil cooling to large-sized products having a large wall thickness and a complex shape and having a weight exceeding 1 metric ton in view of a problem of crack initiation owing to heat stress at the cooling and safety problems such as phreatic explosion and hence usually, air cooling or fan cooling is performed in the heat treatments such as quenching and normalizing. When a cooling rate is low as mentioned above, there is a problem that it is difficult to secure sufficient strength and toughness in SCW480 or SCW550, or in the ingredient range described in each of the above-described Patent Literatures.

The invention is devised to secure high strength and high toughness in the large-sized cast steel products as mentioned above, and an object of the invention is to provide a cast steel material capable of obtaining sufficiently high strength and toughness even by air cooling or fan cooling and a method for producing the material.

Means for Solving the Problems

The invention relates to the following high strength and high toughness cast steel material and method for producing the same.

<1> A high strength and high toughness cast steel material, which has a composition containing 0.10 to 0.20% by mass of C, 0.10 to 0.50% by mass of Si, 0.40 to 1.20% by mass of Mn, 2.00 to 3.00% by mass of Ni, 0.20 to 0.70% by mass of Cr, and 0.10 to 0.50% by mass of Mo, and further containing Fe and unavoidable impurities.

<2> The high strength and high toughness cast steel material according to <1>, wherein the product mass is 1 metric ton or more.

<3> The high strength and high toughness cast steel material according to <1> or <2>, further containing 0.05% by mass or less of V as a compositional ingredient.

<4> The high strength and high toughness cast steel material according to any one of <1> to <3>, further containing 20 to 150 ppm by mass of N as a compositional ingredient.

<5> The high strength and high toughness cast steel material according to any one of <1> to <4>, wherein the high strength and high toughness cast steel material contains less than 0.01% by mass of Al, less than 0.01% by mass of Ti, 0.025% by mass or less of Sn, less than 0.015% by mass of P, and less than 0.015% by mass of S as the unavoidable impurities.

<6> A method for producing a high strength and high toughness cast steel material, for an ingot having a composition containing 0.10 to 0.20% by mass of C, 0.10 to 0.50% by mass of Si, 0.40 to 1.20% by mass of Mn, 2.00 to 3.00% by mass of Ni, 0.20 to 0.70% by mass of Cr, and 0.10 to 0.50% by mass of Mo, and further containing Fe and unavoidable impurities, the method comprising: an annealing step of performing a heat treatment at 1,000 to 1,100° C.; a quenching step of performing a heat treatment at 850 to 950° C.; and a tempering step of performing a heat treatment at 610 to 670° C.

<7> The method for producing a high strength and high toughness cast steel material according to <6>, further comprising a stress-relief annealing step of performing a heat treatment at less than 610° C. after the tempering step.

<8> The method for producing a high strength and high toughness cast steel material according to <6> or <7>, wherein the annealing step and the quenching step each comprise a cooling step, and wherein in both cooling steps, cooling is performed at a cooling rate lower than that in the case of cooling by liquid immersion.

<9> The method for producing a high strength and high toughness cast steel material according to any one of <6> to <8>, wherein the composition of the ingot further satisfies at least one of the requirement that the ingot contains 0.05% by mass or less of V and the requirement that the ingot contains 20 to 150 ppm by mass of N.

Advantageous Effects of the Invention

As explained above, since the high strength and high toughness cast steel material of the invention has a specific composition, even in a large-sized cast steel material, sufficiently high strength and toughness can be obtained by air cooling or fan cooling without applying plastic working and also without performing liquid cooling such as water cooling or oil cooling at the time of quenching.

MODE FOR CARRYING OUT THE INVENTION

<Cast Steel Material>

Figure 1:
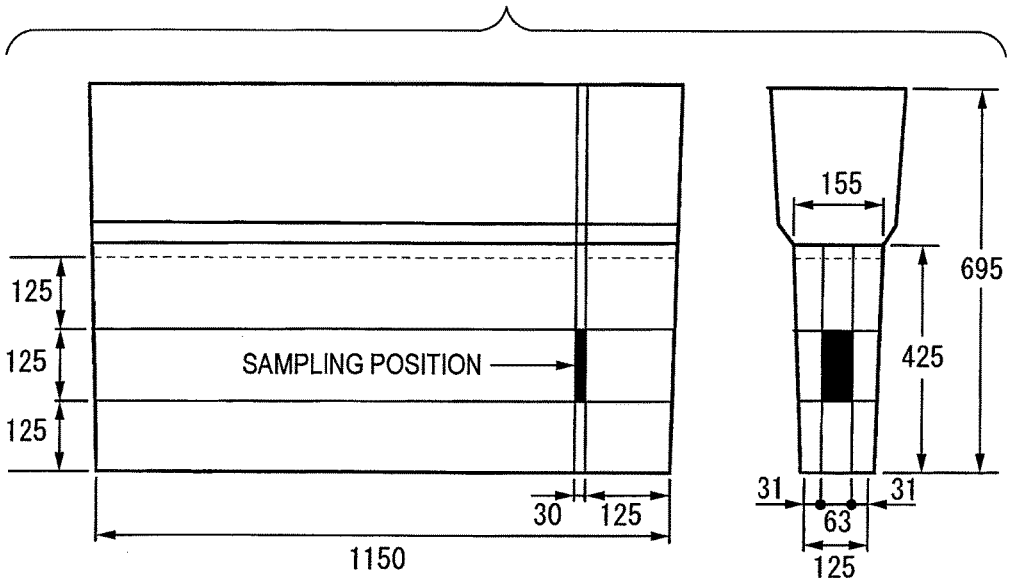
FIG. 1 is a figure showing a test material produced with the same charge as a large-sized cast steel product and a position at which various mechanical test pieces are sampled from the test material.

The following will explain one embodiment of the invention.

In the present specification, the cases simply described as "%" and "ppm" means "% by mass" and "ppm by mass", respectively.

The high strength and high toughness cast steel material of the invention (hereinafter also described as "cast steel material of the invention") contains, by mass, C: 0.10 to 0.20%, Si: 0.10 to 0.50%, Mn: 0.40 to 1.20%, Ni: 2.00 to 3.00%, Cr: 0.20 to 0.70%, Mo: 0.10 to 0.50% and contains Fe and unavoidable impurities as others. Furthermore, if desired, it contains one or both of V: 0.05% or less and N: 20 to 150 ppm.

The following will show limitation reasons for the above composition in the invention.

C (carbon): 0.10 to 0.20%

C is an element which improves the strength and the hardenability. However, when C is added excessively, it becomes difficult to obtain prescribed toughness and also susceptibility to weld crack becomes high. Taking these factors into account, the content of C is determined to be 0.10 to 0.20%. For the same reasons, a desirable lower limit is 0.12% and a desirable upper limit is 0.16%.

Si (silicon): 0.10 to 0.50%

Si is used as a deoxidizing agent and is an element which improves the hardenability. However, since segregation increases and also a non-metal inclusion forms excessively to lower the toughness when Si is added excessively, the content is determined to be 0.10 to 0.50%. For the same reasons, a desirable lower limit is 0.20%, and a desirable upper limit is 0.40% and a further desirable upper limit is 0.30%.

Mn (manganese): 0.40 to 1.20%

Mn is an element which improves the strength and the hardenability. However, when the content is less than 0.40%, prescribed strength is not obtained. On the other hand, when the content exceeds 1.20%, the strength is too high to obtain prescribed ductility and toughness, and also temper embrittlement may occur. Therefore, the content of Mn is determined to be 0.40 to 1.20%. For the same reasons, a desirable lower limit is 0.50% and a desirable upper limit is 1.00%.

Ni (nickel): 2.00 to 3.00%

Ni is an element which improves the strength and the hardenability and also has an effect of improving low-temperature toughness. On the other hand, Ni has inversely an action of lowering the strength and the toughness by excessive addition and also there is a concern of weld crack initiation. Moreover, since Ni is an expensive element, it is desirable to suppress the amount to be added. Taking the above facts into account, the content of Ni is determined to be 2.00 to 3.00%. For the same reasons, a desirable lower limit is 2.20% and a desirable upper limit is 2.60%.

Cr (chromium): 0.20 to 0.70%

Cr is an element which improves the strength and the hardenability. Since the strength is improved by carbide formation, prescribed strength is not obtained when the content is low. On the other hand, excessive addition thereof causes deterioration in weldability. Therefore, the content of Cr is determined to be 0.20 to 0.70%. For the same reasons, a desirable lower limit is 0.40% and a desirable upper limit is 0.65%.

Mo (molybdenum): 0.10 to 0.50%

Mo is an element which improves the hardenability and reduces temper embrittlement. On the other hand, excessive addition thereof causes deterioration in weldability. Therefore, the content of Mo is determined to be 0.10 to 0.50%. For the same reasons, a desirable lower limit is 0.15% and a desirable upper limit is 0.25%.

The cast steel material of the invention may further contain the following compositional ingredients, if desired.

V (vanadium): 0.05% or less

V is an element which improves the strength by precipitation hardening and hence may be contained, if desired. On the other hand, it is an element which inhibits weldability and also considerably lowers the toughness by excessive addition thereof. Therefore, when V is contained, the content is determined to be 0.05% or less. In order to sufficiently obtain the effect by precipitation hardening, it is preferred to contain it in an amount of 0.02% or more.

N (nitrogen): 20 to 150 ppm

N is an ingredient which is contained unavoidably but has an effect of refinement of crystal grains and increase in yield strength through the formation of nitrides with V and the like. However, there is a concern that lowering of the toughness may be caused by excessive precipitation of TiN. In order to secure mechanical properties, a remaining amount of 20 to 150 ppm is desirable and a lower limit of 50 ppm and an upper limit of 120 ppm are more desirable.

(Unavoidable Impurities)

The cast steel material of the invention may further contain unavoidable impurities in allowable content. As the unavoidable impurities contained in the cast steel material of the invention, it is preferred to restrict Al, Ti, Sn, P, and S within specific amounts shown in the following. Also, with regard to unavoidable impurities other than the above-described ones, it is preferred to suppress the content for the purpose of improving mechanical properties.

Al (aluminum): less than 0.01%

Al is an element to be added as a deoxidizing agent and has an effect of forming AlN at the time of deoxidation and heat treatment to prevent austenite grains from coarsening. However, in a cast steel, since sand marks owing to $Al_2O_3$, defect generation owing to rock candy, and the like become problems, it is desirable to reduce the remaining amount thereof as far as possible. Therefore, an amount of less than 0.01% is suitable.

Ti (titanium): less than 0.01%

Ti is an element which improves the strength by precipitation of TiN. On the other hand, excessive precipitation of TiN causes lowering of the toughness. Since a certain degree of N contamination is unavoidable in large-sized cast steel products to be produced by casting in air atmosphere, it is desirable to reduce the amount of Ti as far as possible for securing high toughness and thus an amount of less than 0.01% is more desirable.

Sn (tin): 0.025% or less

Sn is an element which considerably lowers the toughness by adding it in an amount of 0.03% or more. In order to secure high toughness, it is desirable to control the content to 0.025% or less and a content of less than 0.01% is more desirable.

P (phosphorus): less than 0.015%

S (sulfur): less than 0.015%

P and S are impurity ingredients unavoidably contained but P embrittles crystal grain boundary and S binds to Mn and the like to form inclusions, so that both have an action of lowering mechanical properties. In order to secure the mechanical properties, it is desirable to reduce the remaining amounts as far as possible and a content of less than 0.015% is suitable.

<Production Method>

The following will explain the method for producing the cast steel material of the invention.

With regard to the cast steel material of the invention, a cast steel material (raw shape material) can be obtained by casting according to a usual method and the casting method is not particularly limited.

With regard to the above cast steel material of the invention, for example, after a molten raw material is prepared by melting according to a usual method and adjusted to the above-described composition, an ingot is obtained by casting with a mold. Thereafter, a heat treatment at 1,000 to 1,100° C. is performed as an annealing step, then a heat treatment at 850 to 950° C. is performed as a quenching step, further a heat treatment at 610 to 670° C. is performed as a tempering step, and further, if necessary, a heat treatment at less than 610° C. is performed as a subsequent stress-relief annealing step, whereby the cast steel material can be produced.

Annealing Step: 1,000 to 1,100° C.

Annealing is performed for the purpose of relieving stress generated in the mold at the time of casting and homogenizing inhomogeneous ingredients generated at the time of solidification, and heating is performed at least 1000° C. or more. However, since the crystal grains are excessively coarsened and the toughness is lowered when heating is performed at a temperature exceeding 1,100° C., the heating is restricted to the temperature range of 1,000 to 1,100° C.

Quenching Step: 850 to 950° C.

Quenching and tempering are performed for securing the mechanical properties. In the quenching, it is necessary to control the temperature to 850° C. or more in order to achieve an austenite single-phase state but the coarsening of the crystal grains starts when the temperature exceeds 950° C. and the toughness is excessively lowered, so that the temperature is restricted to the temperature range of 850 to 950° C.

Tempering Step: 610 to 670° C.

Since the tensile strength is lowered when the temperature is exceedingly high and the toughness is lowered when an austenite phase precipitates through reverse transformation, it is necessary to perform tempering at 670° C. or less. Moreover, when the tempering is performed at exceedingly low temperature, a balance between strength and toughness becomes worse and the toughness is lowered, so that it is desirable to perform the tempering at 610° C. or more. Accordingly, the tempering is restricted to the temperature range of 610 to 670° C.

Incidentally, the heating-holding time at the above annealing, quenching, and tempering is determined depending on the thickness of products but it is desirable to hold the heating for 10 hours or more in order to achieve a sufficient effect.

Stress-relief Annealing Step: Less Than 610° C.

The stress-relief annealing step is performed for the purpose of relieving stress generated at the time of structure welding and repair welding and is added after the tempering step, if desired. In order to sufficiently exhibit the stress-relief effect, it is necessary to perform the present step at a temperature as high as possible. However, when it is performed at a temperature equal to the tempering temperature, the mechanical properties are influenced, so that the step is desirably performed at less than 610° C. Moreover, the holding time is also determined depending on a welded amount but it is desirable to hold the temperature for 4 hours or more in order to achieve a sufficient effect.

In addition, according to the invention, even when cooling is performed at a cooling rate lower than that realized by liquid immersion at the time of the so-called austenitizing treatment including annealing and quenching, sufficiently high strength and toughness can be obtained. As cooling methods at such a cooling rate, for example, air cooling and fan cooling may be mentioned.

The cast steel material of the invention obtained by the above-described production method has high strength and high toughness. The material can be suitably utilized for final products having a mass of 1 metric ton or more and having a maximum wall thickness of 100 mm or more.

The cast steel material of the invention is suitable for cast steel products having a product mass of particularly 1 metric ton or more, further preferably 5 metric tons or more, more preferably 10 metric tons or more. Furthermore, it is suitable for complex-shaped products having a maximum wall thickness of 100 mm to 300 mm. However, the invention is not limited to those having a product mass or a maximum wall thickness each falling within the above range.

EXAMPLES

The following will explain the invention with comparing Examples of the invention to Comparative Examples.

The ingredients shown in Table 1 were melted in a vacuum induction melting furnace (hereinafter referred to as VIM) and cast into a sand mold having a length of 240 mm, a height of 250 mm, and a width of 90 mm to obtain an ingot. The ingot was cut into a size having a length of 80 mm, a height of 120 mm, and a width of 30 mm and, after the cut ingot was held at 1050° C. for 20 hours, annealing was performed by cooling at a rate of 50° C./hour. Then, after it was held at 890° C. for 20 hours, quenching was performed by cooling at a rate of 300° C./hour. The cooling rate at the time of quenching simulates a cooling rate upon fan cooling at a spot at a depth of 125 mm from the surface of a large-sized cast steel product.

Further, after holding at 610° C. for 20 hours, tempering was performed by cooling at a rate of 50° C./hour and further, after holding at 600° C. for 6 hours, annealing was performed by cooling at a rate of 75° C./hour. The annealing simulates stress-relief annealing which relieves residual stress loaded by welding and the like.

A tensile test piece and a Charpy impact test piece were prepared from the above cut ingot after the heat treatments and then subjected to the tests. The tensile test was carried out with a test piece of JIS No. 14-A and the Charpy impact test was carried out with a test piece of V-notch according to JIS No. 4.

Moreover, a tensile test piece and a Charpy impact test piece were prepared from a test material produced with the same charge as the above large-sized cast steel product having ingredients shown in Table 1 and then subjected to the tests.

TABLE 1

| | Sample material composition (% by mass, remainder being Fe and the other impurities) | | | | | | | | | | | | |
|---|---|---|---|---|---|---|---|---|---|---|---|---|---|
| | C | Si | Mn | P | S | Ni | Cr | Mo | V | Al | Ti | Sn | N |
| Inventive steel 1 | 0.16 | 0.25 | 0.54 | 0.006 | 0.003 | 2.45 | 0.60 | 0.19 | 0.05 | <0.005 | <0.005 | 0.004 | 0.008 |

FIG. 1 shows the above test material and a position at which the above tensile test piece and the above Charpy impact test piece are sampled from the test material.

The tensile test was performed using the tensile test piece, and tensile strength, 0.2% yield strength, elongation, and reduction of area were confirmed. The test was carried out at room temperature.

Moreover, the Charpy impact test was performed using the Charpy impact test piece and absorbed energy was confirmed. The test was carried out at 0° C.

Test results for the above ingot and the above test material are shown in Table 2. Since this degree of strength and toughness was necessary as a structural material for which high strength and high toughness were required, targets of individual mechanical properties for large-sized cast steel products were judged to be a tensile strength of 620 MPa or more and an absorbed energy of 75 J or more.

Moreover, from the results shown in Table 2, it was confirmed that a large difference was not observed in strength but the absorbed energy of the test material was lower than that of the ingot by about 20 J. Therefore, a target value for a small-sized test material was decided as a tensile strength of 620 MPa or more and an absorbed energy of 95 J or more.

Furthermore, since the stress-relief annealing temperature was 600° C., the annealing temperature was defined as 610° C. or more.

TABLE 2

| | Tensile strength (MPa) average of 2 pieces | 0.2% Yield strength (MPa) average of 2 pieces | Elongation (%) average of 2 pieces | Reduction of area (%) average of 2 pieces | Absorbed energy (J) average of 3 pieces |
|---|---|---|---|---|---|
| VIM-prepared ingot | 680 | 520 | 28.6 | 69.0 | 94 |
| Test material produced with the same charge as large-sized cast steel product | 668 | 544 | 20.8 | 45.8 | 78 |

The following shows test results from which individual ingredient ranges are determined.

The ingredients of comparative materials where the amount of V is changed are shown in Table 3. The ingredients shown in Table 3 were melted in VIM and cast into a sand mold having a length of 240 mm, a height of 250 mm, and a width of 90 mm to obtain an ingot. The ingot was cut into a size having a length of 80 mm, a height of 120 mm, and a width of 30 mm and, after the cut ingot was held at 1020° C. for 20 hours, annealing was performed by cooling at a rate of 50° C./hour. Then, after holding at 910° C. for 20 hours, quenching was performed by cooling at a rate of 300° C./hour. Further, after holding at 640° C. for 20 hours, tempering was performed by cooling at a rate of 50° C./hour and then, after holding at 600° C. for 6 hours, stress-relief annealing was performed by cooling at a rate of 75° C./hour.

TABLE 3

| | Sample material composition (% by mass, remainder being Fe and the other impurities) | | | | | | | | | | | | |
|---|---|---|---|---|---|---|---|---|---|---|---|---|---|
| | C | Si | Mn | P | S | Ni | Cr | Mo | V | Al | Ti | Sn | N |
| Comparative material 1 | 0.17 | 0.39 | 1.77 | 0.007 | 0.003 | 2.50 | 0.59 | 0.30 | — | <0.005 | <0.005 | 0.004 | 0.008 |
| Comparative material 2 | 0.16 | 0.39 | 1.83 | 0.007 | 0.003 | 2.51 | 0.60 | 0.31 | 0.03 | <0.005 | <0.005 | 0.004 | 0.008 |

Test results with the above test materials are shown in Table 4. As shown by the results, the strength is increased when V is contained only a small amount but the toughness is lowered. This is attributable to precipitation hardening induced by V and thus this fact indicates that excessive addition of V is forbidden to large-sized cast steel materials.

TABLE 4

| | V (wt %) | Annealing temperature (° C.) | Quenching temperature (° C.) | Tempering temperature (° C.) | Stress-relief annealing temperature (° C.) | Tensile strength (MPa) average of 2 pieces | 0.2% Yield strength (MPa) average of 2 pieces | Elongation (%) average of 2 pieces | Reduction of area (%) average of 2 pieces | Absorbed energy (J) average of 3 pieces |
|---|---|---|---|---|---|---|---|---|---|---|
| Comparative material 1 | — | 1020 | 910 | 640 | 600 | 769 | 552 | 25.2 | 51.1 | 52 |
| Comparative material 2 | 0.03 | 1020 | 910 | 640 | 600 | 793 | 578 | 25.8 | 47.8 | 30 |

The ingredients of test materials where the amounts of Mn and Ni are changed are shown in Table 5. The ingredients shown in Table 5 were melted in VIM and cast into a sand mold having a length of 240 mm, a height of 250 mm, and a width of 90 mm to obtain an ingot. The ingot was cut into a size having a length of 80 mm, a height of 120 mm, and a width of 30 mm and, after the cut ingot was held at 1050° C. for 20 hours, annealing was performed by cooling at a rate of 50° C./hour. Then, after holding at 890° C. for 20 hours, quenching was performed by cooling at a rate of 300° C./hour. Further, after holding at 640° C. and 610° C. for 20 hours, tempering was performed by cooling at a rate of 50° C./hour and then, after holding at 600° C. for 6 hours, stress-relief annealing was performed by cooling at a rate of 75° C./hour.

TABLE 5

| | Sample material composition (% by mass, remainder being Fe and the other impurities) | | | | | | | | | | | |
|---|---|---|---|---|---|---|---|---|---|---|---|---|
| | C | Si | Mn | P | S | Ni | Cr | Mo | V | Al | Ti | N |
| Inventive steel 2 | 0.14 | 0.24 | 1.02 | 0.006 | 0.003 | 2.47 | 0.60 | 0.19 | 0.02 | <0.005 | <0.005 | 0.008 |
| Inventive steel 3 | 0.16 | 0.24 | 0.52 | 0.006 | 0.003 | 2.42 | 0.60 | 0.18 | 0.02 | <0.005 | <0.005 | 0.008 |
| Inventive steel 4 | 0.16 | 0.25 | 0.50 | 0.006 | 0.003 | 2.50 | 0.45 | 0.20 | 0.02 | <0.005 | <0.005 | 0.008 |
| Comparative material 3 | 0.16 | 0.24 | 0.53 | 0.006 | 0.003 | 3.48 | 0.60 | 0.18 | 0.02 | <0.005 | <0.005 | 0.008 |
| Comparative material 4 | 0.16 | 0.25 | 1.03 | 0.006 | 0.003 | 3.50 | 0.60 | 0.19 | 0.02 | <0.005 | <0.005 | 0.008 |
| Comparative material 5 | 0.17 | 0.24 | 0.75 | 0.008 | 0.003 | 1.50 | 0.62 | 0.20 | 0.04 | <0.005 | <0.005 | 0.005 |
| Comparative material 6 | 0.16 | 0.24 | 0.74 | 0.007 | 0.003 | 1.97 | 0.62 | 0.19 | 0.04 | <0.005 | <0.005 | 0.004 |
| Comparative material 7 | 0.16 | 0.25 | 0.50 | 0.006 | 0.003 | 2.50 | 0.10 | 0.20 | 0.02 | <0.005 | <0.005 | 0.005 |
| Comparative material 8 | 0.16 | 0.25 | 0.50 | 0.006 | 0.003 | 2.50 | 0.75 | 0.20 | 0.02 | <0.005 | <0.005 | 0.008 |
| Comparative material 9 | 0.16 | 0.25 | 0.50 | 0.006 | 0.003 | 2.50 | 1.20 | 0.20 | 0.02 | <0.005 | <0.005 | 0.004 |

Figure 2:
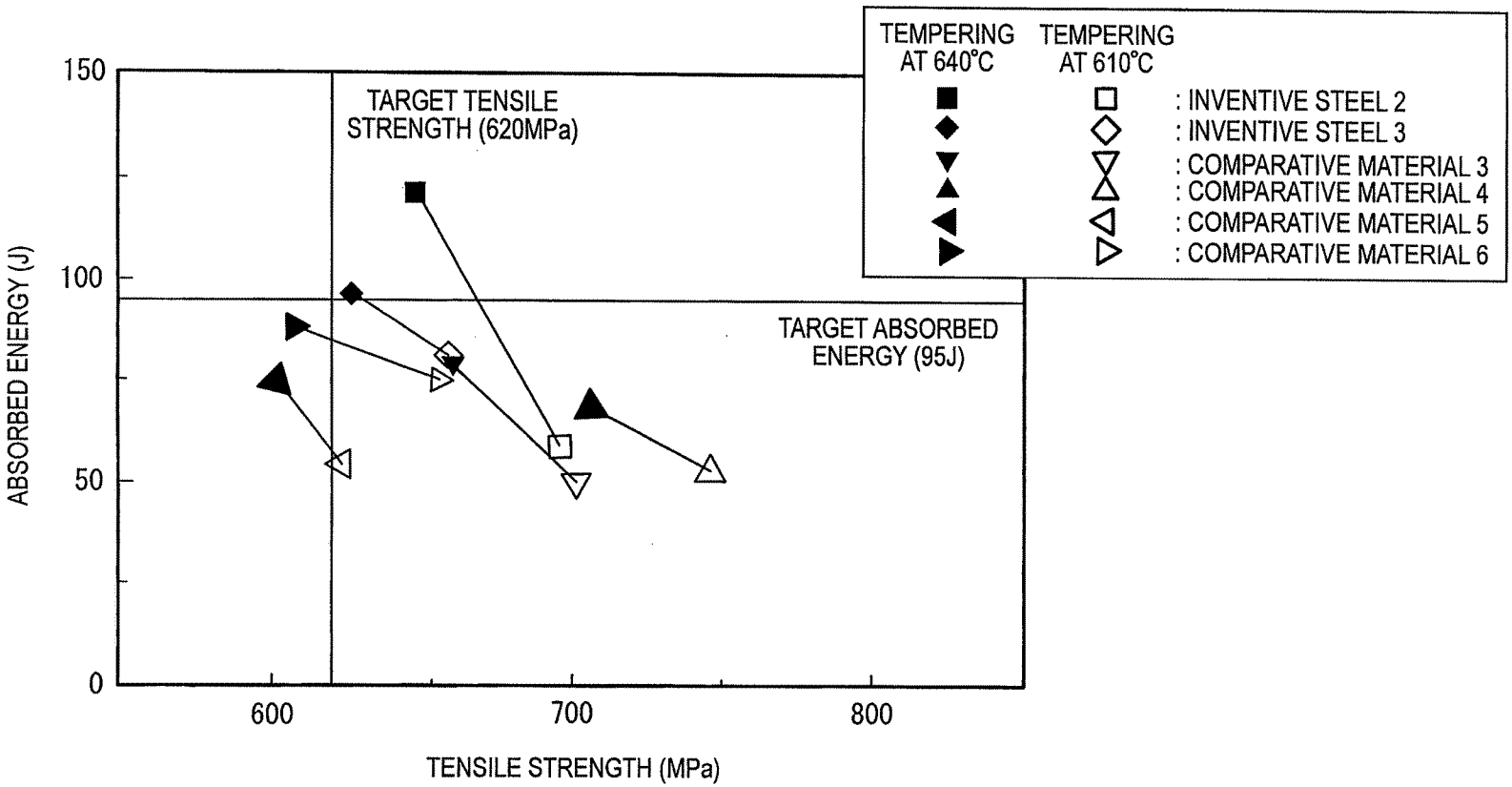
FIG. 2 is a graph showing the relationship between tensile strength and absorption energy based on the results shown in Table 6.

Test results with the above test materials are shown in Table 6. FIG. 2 shows the relationship between the tensile strength and the absorbed energy based on the results shown in Table 6. As shown by the results, the strength and the toughness are increased in the case of the Ni addition of about 2.50% or less (inventive steels and 3) and target strength and toughness can be obtained by adding 2.00 to 3.00% of Ni. However, when Ni is added until 3.50% (comparative materials 3 and 4), both of the strength and the toughness are lowered inversely, so that the cases are regarded as excessive addition.

TABLE 6

| | Sample material composition (% by mass) (remainder being Fe and the other impurities) | | | | | Annealing temperature | Quenching temperature | Tempering temperature | Stress-relief annealing temperature | Tensile strength (MPa) average of 2 | 0.2% Yield strength (MPa) average of 2 | Elongation (%) average of 2 | Reduction of area (%) average of 2 | Absorbed energy (J) average of 3 |
|---|---|---|---|---|---|---|---|---|---|---|---|---|---|---|
| | C | Mn | Ni | Cr | V | (° C.) | (° C.) | (° C.) | (° C.) | pieces | pieces | pieces | pieces | pieces |
| Inventive steel 2 | 0.14 | 1.02 | 2.47 | 0.60 | 0.02 | 1050 | 890 | 640 | 600 | 648 | 511 | 27.2 | 67.3 | 121 |
| | | | | | | | | 610 | | 696 | 564 | 24.6 | 64.0 | 58 |
| Inventive steel 3 | 0.16 | 0.52 | 2.42 | 0.60 | 0.02 | 1050 | 890 | 640 | 600 | 626 | 477 | 28.0 | 65.7 | 97 |
| | | | | | | | | 610 | | 659 | 508 | 27.8 | 63.1 | 81 |
| Inventive steel 4 | 0.16 | 0.50 | 2.50 | 0.45 | 0.02 | 1050 | 890 | 640 | 600 | 622 | 473 | 28.0 | 66.7 | 110 |
| | | | | | | | | 610 | | 640 | 486 | 27.0 | 64.0 | 90 |
| Comparative material 3 | 0.16 | 0.53 | 3.48 | 0.60 | 0.02 | 1050 | 890 | 640 | 600 | 660 | 522 | 27.4 | 66.5 | 78 |
| | | | | | | | | 610 | | 701 | 563 | 26.2 | 64.0 | 50 |
| Comparative material 4 | 0.16 | 1.03 | 3.50 | 0.60 | 0.02 | 1050 | 890 | 640 | 600 | 706 | 511 | 25.2 | 58.7 | 68 |
| | | | | | | | | 610 | | 746 | 608 | 22.8 | 56.7 | 52 |
| Comparative material 5 | 0.17 | 0.75 | 1.50 | 0.62 | 0.04 | 1050 | 890 | 640 | 600 | 603 | 449 | 28.8 | 68.6 | 74 |
| | | | | | | | | 610 | | 624 | 464 | 28.0 | 65.7 | 54 |
| Comparative material 6 | 0.16 | 0.74 | 0.97 | 0.62 | 0.04 | 1050 | 890 | 640 | 600 | 608 | 464 | 28.6 | 68.2 | 88 |
| | | | | | | | | 610 | | 656 | 516 | 26.6 | 66.5 | 75 |
| Comparative material 7 | 0.16 | 0.50 | 2.50 | 0.10 | 0.02 | 1050 | 890 | 640 | 600 | 585 | 445 | 29.0 | 68.6 | 125 |
| | | | | | | | | 610 | | 608 | 462 | 28.0 | 65.7 | 100 |
| Comparative material 8 | 0.16 | 0.50 | 2.50 | 0.75 | 0.02 | 1050 | 890 | 640 | 600 | 645 | 490 | 27.0 | 67.0 | 82 |
| | | | | | | | | 610 | | 668 | 508 | 26.5 | 61.5 | 60 |
| Comparative material 9 | 0.16 | 0.50 | 2.50 | 1.20 | 0.02 | 1050 | 890 | 640 | 600 | 682 | 502 | 26.2 | 61.0 | 60 |
| | | | | | | | | 610 | | 706 | 515 | 25.2 | 58.7 | 42 |

With regard to Mn, by comparing the comparative material 2 in the above Table 4 with the inventive steels and 3 in the above table 6, a suitable content was surmised. Namely, when about 1.80% of Mn is added, the strength is too high to obtain prescribed toughness. On the other hand, in the inventive steels 2 and 3 containing 0.50% to 1.00% of Mn, target strength and toughness are obtained. However, taking a balance between the strength and the toughness into account, when Mn is further reduced, target strength is no longer obtained.

From the above results, the amount of Ni to be added was determined to be 2.00 to 3.00% and the amount of Mn to be added was determined to be 0.40 to 1.20%.

Moreover, for the inventive steel 3, quenching was performed at cooling rates of 50° C./hour, 300° C./hour, and 900° C./hour. The cooling rates of 50° C./hour and 900° C./hour simulate cooling rates by furnace cooling and spray cooling at a spot at a depth of 125 mm from the surface of a large-sized cast steel product, respectively.

Test results of the tensile test and the Charpy impact test with test ingots obtained by quenching the inventive steel 3 at various cooling rates are shown in Table 7.

It was confirmed that both of the strength and the toughness tend to be improved in the inventive steel as the cooling rate at the time of quenching increases.

Although sufficient strength and toughness could not be secured by furnace cooling, it was confirmed that sufficient strength and toughness could be secured when fan cooling and spray cooling were performed.

From the above results, for the ingredients of the inventive steels 1 to 3, it was confirmed that a high strength and high toughness steel was obtained without performing liquid cooling such as water cooling or oil cooling at the heat treatments such as quenching and normalizing in the above large-sized cast steel products.

Incidentally, although the elevation of the tempering temperature is effective for improving the toughness, the inventive steels 1 to 3 have a eutectoid temperature of about 690° C. and hence 670° C. is the upper limit of the tempering temperature when temperature error in a commercial operation is considered. When considered including the test results, the tempering temperature is suitably 610 to 670° C.

While the invention has been described in detail and with reference to specific embodiments thereof, it will be apparent to one skilled in the art that various changes and modifications can be made therein without departing from the spirit and scope thereof. The present application is based

TABLE 7

| | Sample material composition (% by mass) (remainder being Fe and the other impurities) | | | | | Cooling rate | Tempering temperature | Tensile strength (MPa) average of 2 | 0.2% Yield strength (MPa) average of 2 | Elongation (%) average of | Reduction of area (%) average of 2 | Absorbed energy (J) average of 3 |
|---|---|---|---|---|---|---|---|---|---|---|---|---|
| | C | Mn | Ni | Cr | V | (° C./hour) | (° C.) | pieces | pieces | 2 pieces | pieces | pieces |
| Inventive steel 3 | 0.16 | 0.54 | 2.45 | 0.60 | 0.02 | 50 | 640 | 586 | 430 | 28.8 | 64.4 | 72 |
| | | | | | | 300 | 640 | 626 | 477 | 28.0 | 65.7 | 97 |
| | | | | | | 900 | 640 | 643 | 522 | 25.3 | 63.7 | 117 |

Figure 3:
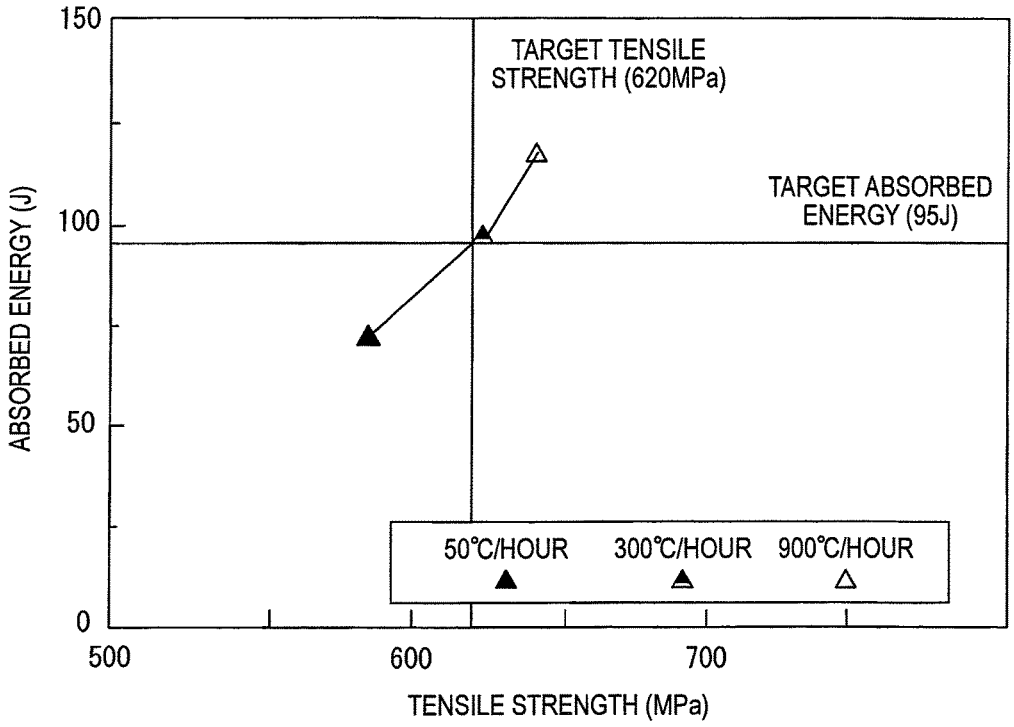
FIG. 3 is a graph showing the relationship between tensile strength and absorption energy based on the results shown in Table 7.

FIG. 3 shows the relationship between the tensile strength and the absorption energy based on the results shown in Table 7.

on Japanese Patent Application No. 2009-220750 filed on Sep. 25, 2009, and the contents are incorporated herein by reference.

INDUSTRIAL APPLICABILITY

Since sufficiently high strength and toughness are obtained even by air cooling or fan cooling, the high strength and high toughness cast steel material of the invention is particularly useful for large-sized cast steel products to which liquid cooling such as water cooling or oil cooling is difficult to apply at the time of heat treatments such as quenching and normalizing and which have such a large thickness that the maximum wall thickness is 100 mm to 300 mm and a complex shape or have a weight exceeding 1 metric ton.

The invention claimed is:

1. A cast steel product comprising a cast steel material, which has a composition containing 0.14 to 0.20% by mass of C, 0.10 to 0.50% by mass of Si, 0.40 to 1.20% by mass of Mn, 2.42 to 3.00% by mass of Ni, 0.40 to 0.70% by mass of Cr, less than 0.004% by mass of Al, and 0.10 to 0.50% by mass of Mo, and further containing Fe and unavoidable impurities, wherein the cast steel material further comprises more than 90 ppm by mass and 150 ppm or less by mass of N as a compositional ingredient, and wherein the cast steel product has absorbed energy of 75 J or more measured by a Charpy impact test carried out using a test piece of V-notch according to JIS (Japanese Industrial Standard) No. 4 Test Piece and at a temperature of 0° C. and wherein the cast steel material has a tensile strength of 620 MPa to 696 MPa.

2. The cast steel product according to claim 1, wherein the product mass is 1 metric ton or more.

3. The cast steel product according to claim 1, wherein the cast steel material further contains 0.05% by mass or less of V as a compositional ingredient.

4. The cast steel product according to claim 3, wherein the cast steel material contains V in an amount of 0.02% by mass or more and 0.05% by mass or less.

5. The cast steel product according to claim 1, wherein the cast steel material contains less than 0.01% by mass of Ti, 0.025% by mass or less of Sn, less than 0.015% by mass of P, and less than 0.015% by mass of S as the unavoidable impurities.

6. The cast steel product according to claim 1, wherein Mn is present in a range of 0.40-0.54% by mass.

7. A method for producing a cast steel material, comprising:

a step of casting an ingot having a composition containing 0.14 to 0.20% by mass of C, 0.10 to 0.50% by mass of Si, 0.40 to 1.20% by mass of Mn, 2.20 to 3.00% by mass of Ni, 0.20 to 0.70% by mass of Cr, less than 0.005% by mass of Al, and 0.10 to 0.50% by mass of Mo, and further containing Fe and unavoidable impurities, wherein the composition of the ingot further comprises more than 80 ppm by mass and 150 ppm or less by mass of N, an annealing step of performing a heat treatment at 1,000 to 1,100° C. on said ingot having said composition;

then a quenching step of performing a heat treatment at 850 to 950° C. on said ingot having said composition; and then a tempering step of performing a heat treatment at 610 to 670° C. on said ingot having said composition, wherein the annealing step and the quenching step each comprises a cooling step, wherein in both cooling steps, cooling is performed at a cooling rate lower than that of cooling by liquid immersion, wherein in the quenching step, cooling is performed at a cooling rate of about 300° C./hour, and wherein the method does not include performing liquid cooling.

8. The method for producing a cast steel material according to claim 7, further comprising a stress-relief annealing step of performing a heat treatment at less than 610° C. after the tempering step.

9. The method for producing a cast steel material according to claim 7, wherein the composition of the ingot further satisfies the requirement that the ingot contains 0.05% by mass or less of V.

10. The method according to claim 9, wherein the ingot contains 0.02% by mass or more and 0.05% by mass or less of V.

11. The method according to claim 7, wherein the cast steel material has a tensile strength of 620 MPa or more.

12. The method according to claim 1, wherein the ingot mass is 1 metric ton or more.

13. The method for producing a cast steel material according to claim 7, wherein Mn is present in a range of 0.40-0.54% by mass.

* * * * *